US011009190B2

(12) United States Patent
Zhou et al.

(10) Patent No.: US 11,009,190 B2
(45) Date of Patent: May 18, 2021

(54) LED LAMP AND ASSEMBLING METHOD THEREOF

(71) Applicant: Consumer Lighting (U.S.), LLC, Norwalk, CT (US)

(72) Inventors: Huisheng Zhou, Shanghai (CN); Yin Suo, Shanghai (CN); Haijuan Yan, XiAn (CN)

(73) Assignee: Savant Technologies LLC, East Cleveland, OH (US)

( * ) Notice: Subject to any disclaimer, the term of this patent is extended or adjusted under 35 U.S.C. 154(b) by 0 days.

(21) Appl. No.: 16/553,124

(22) Filed: Aug. 27, 2019

(65) Prior Publication Data

US 2020/0088354 A1 Mar. 19, 2020

Related U.S. Application Data

(63) Continuation of application No. 15/865,643, filed on Jan. 9, 2018, now Pat. No. 10,393,322.

(30) Foreign Application Priority Data

Jan. 17, 2017 (CN) ..... 201710036140.8

(51) Int. Cl.

| | |
|---|---|
| ***F21K 9/232*** | (2016.01) |
| ***F21K 9/238*** | (2016.01) |
| ***F21V 29/90*** | (2015.01) |
| ***F21V 17/12*** | (2006.01) |
| ***F21K 9/90*** | (2016.01) |

(Continued)

(52) U.S. Cl.

CPC ..... *F21K 9/232* (2016.08); *F21K 9/238* (2016.08); *F21K 9/90* (2013.01); *F21V 17/12* (2013.01); *F21V 29/90* (2015.01); *F21K 9/237* (2016.08); *F21V 3/00* (2013.01); *F21V 17/005* (2013.01); *F21V 29/70* (2015.01); *F21V 29/89* (2015.01);

(Continued)

(58) Field of Classification Search

CPC . F21K 9/232; F21K 9/90; F21K 9/238; F21V 29/90; F21V 17/12

See application file for complete search history.

(56) References Cited

U.S. PATENT DOCUMENTS

| | | | |
|---|---|---|---|
| 7,892,031 | B1 | 2/2011 | Mostoller |
| 8,052,310 | B2 | 11/2011 | Gingrich |

(Continued)

FOREIGN PATENT DOCUMENTS

| | | | |
|---|---|---|---|
| CN | 201487630 | U | 5/2010 |
| CN | 102414507 | A | 4/2012 |
| CN | 102472477 | A | 5/2012 |

OTHER PUBLICATIONS

Office Action for Chinese Patent Appl. No. 201710036140.8, dated Aug. 2, 2019, 6 pages.

*Primary Examiner* — Anne M Hines
(74) *Attorney, Agent, or Firm* — Wood IP LLC

(57) ABSTRACT

The present invention discloses an LED lamp comprising a base, a lamp body coupled to the base, a light emitting assembly arranged inside the lamp body, a positioning component fixed on the lamp body and defining a groove, a flexible component having a fixed end fixed to the lamp body and a free end, and a driver board defining a slot and electrically connected with the light emitting assembly, wherein the driver board is disposed in the groove and the free end of the flexible component is locked into the slot. A method for assembling the LED lamp is also described.

10 Claims, 13 Drawing Sheets

(51) Int. Cl.

| | |
|---|---|
| *F21V 17/00* | (2006.01) |
| *F21V 3/00* | (2015.01) |
| *F21Y 105/10* | (2016.01) |
| *F21V 29/70* | (2015.01) |
| *F21Y 115/10* | (2016.01) |
| *F21V 29/89* | (2015.01) |
| *F21K 9/237* | (2016.01) |

(52) U.S. Cl.
CPC ..... *F21Y 2105/10* (2016.08); *F21Y 2115/10* (2016.08)

(56) References Cited

U.S. PATENT DOCUMENTS

| | | | | |
|---|---|---|---|---|
| 8,801,608 | B2 | 8/2014 | Hardenbrook | |
| 8,963,410 | B2 | 2/2015 | Wu | |
| 10,393,322 | B2 | 8/2019 | Zhou et al. | |
| 2007/0247840 | A1 | 10/2007 | Ham | |
| 2014/0300269 | A1* | 10/2014 | Wu ..... | F21K 9/232 313/318.01 |

* cited by examiner

LED LAMP AND ASSEMBLING METHOD THEREOF

FIELD OF INVENTION

The present invention relates generally to an LED lamp and assembling method thereof.

BACKGROUND OF THE INVENTION

Compared with traditional incandescent lamps, LED lamps have many advantages, such as low power consumption, long service life, greater brightness, less heat emission, as well as being more environmentally friendly. LED lamps work by using LED chips as a source of light. In order for an LED chip to emit light normally, LED lamps usually use a driver to drive the LED chip. However, current LED lamp assembly techniques make the driver and other components of the LED lamps difficult to assemble.

Therefore, it is hoped to provide a new and improved LED lamp and assembling method thereof.

BRIEF DESCRIPTION OF THE INVENTION

In one aspect, the specific embodiments of the present invention relate to an LED lamp comprising a base, a lamp body coupled to the base, a light emitting assembly arranged inside the lamp body, a positioning component fixed on the lamp body and defining a groove, a flexible component having a fixed end fixed to the lamp body and a free end, and a driver board defining a slot and electrically connected with the light emitting assembly, wherein the driver board is disposed in the groove and the free end of the flexible component is locked into the slot.

In another aspect, the specific embodiments of the present invention relate to a method for assembling an LED lamp comprising sliding a driver board along a groove of a positioning component fixed on a housing until the free end of a flexible component fixed onto the housing is locked into a slot of the driver board so that the driver board is assembled to the housing, electrically connecting a light emitting assembly with the driver board and assembling the light emitting assembly to the housing, coupling a cover to the housing, and coupling a base to the housing.

BRIEF DESCRIPTION OF THE DRAWINGS

The features, aspects, and advantages of the present invention will be better understood from reading the following detailed description with reference to the accompanying drawings, in which.

DETAILED DESCRIPTION OF THE INVENTION

The following is a description of one or more embodiments of the present invention. It must be first noted that in order to be concise in describing these embodiments, the present specification cannot describe in detail all the characteristics of the actual embodiments. It should be understood that during the actual implementation of any embodiment, just as in any engineering project or design project, in order to achieve the specific objectives of the developer or to meet system-related or business-related restrictions, a variety of decisions are often made and this may change from one embodiment to another. In addition, it should also be understood that while all efforts made during the development process may be complex and lengthy, for general technical personnel involved in the disclosure of the present invention, some changes to the design, manufacture, or production made on the basis of the technical content disclosed are conventional techniques only and should not be understood as insufficient disclosure of the present invention.

Unless otherwise defined, technical terms or scientific terms used in the claims and the specification should be interpreted in the ordinary sense as understood by a person of ordinary skill in the art to which the present invention pertains. "First", "second", and similar words used in the specification and the claims do not denote any order, quantity, or importance but are merely intended to distinguish between different constituents. The terms "one", "a", and similar words are not meant to be limiting but rather denote the presence of at least one. The term "or" includes any one or all of the items listed. The terms "including", "comprising", and the like are intended to mean that the presence of an element or thing preceded by the word "including" or "comprising" encompasses elements or objects listed after "including" or "comprising" and their equivalents, and does not exclude other elements or objects. "Coupled" and similar words refer to indirect or direct connections. Therefore, if the first component is coupled to the second component, the two may be directly connected or indirectly mechanically or electrically connected through other components or connections.

Figure 1:
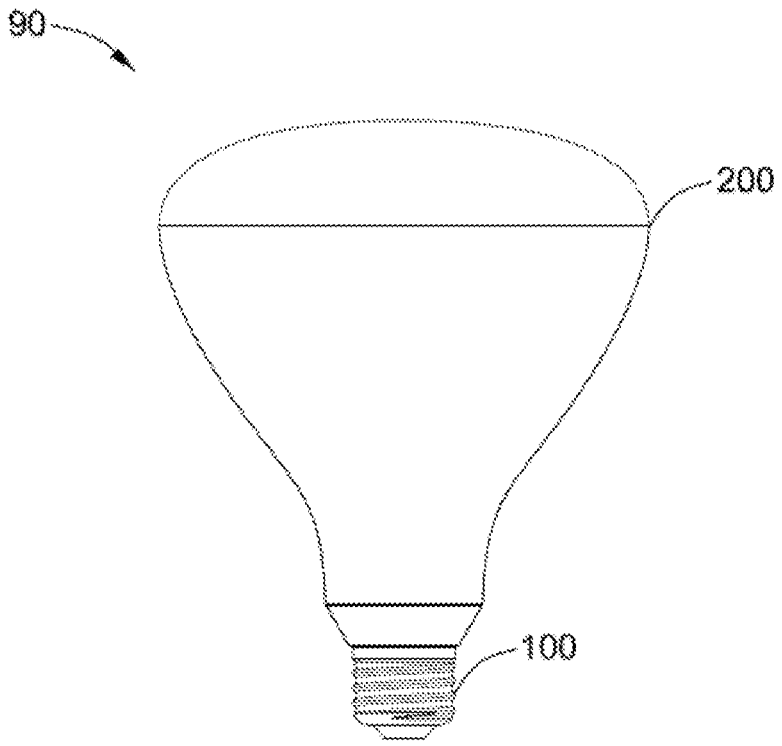
FIG. 1 is a front elevation view of an LED lamp according to an example embodiment of the present invention.
Figure 2:
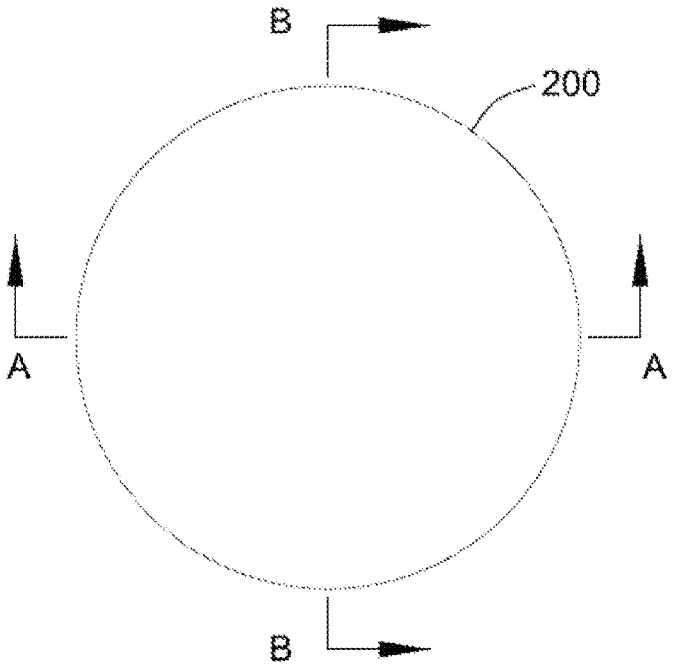
FIG. 2 is a top view of the LED lamp as shown in FIG. 1.
Figure 3:
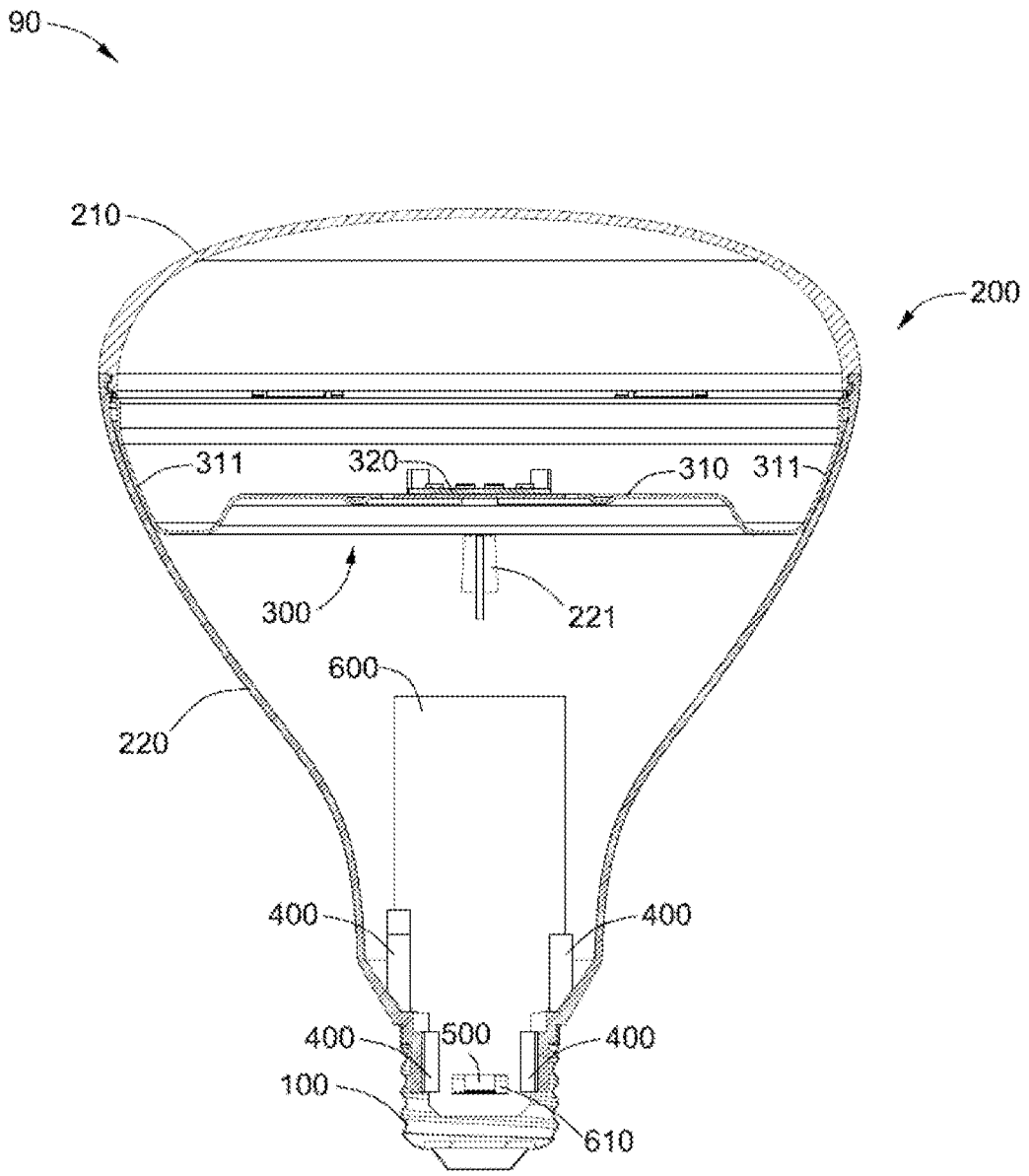
FIG. 3 is a schematic diagram of the cross section structure along the A-A direction in FIG. 2.
Figure 4:
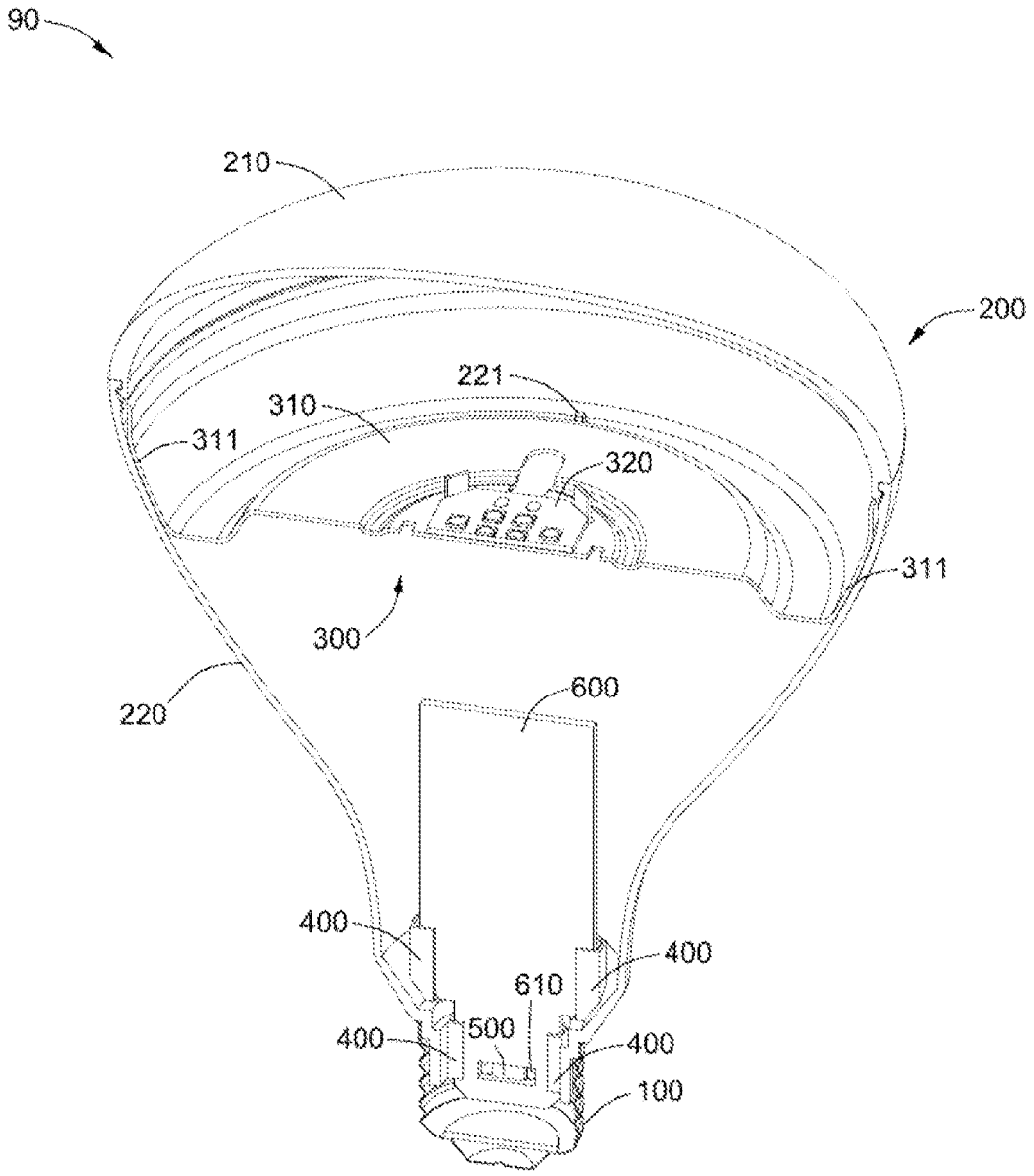
FIG. 4 is a schematic diagram of another perspective of the LED lamp as shown in FIG. 3.
Figure 5:
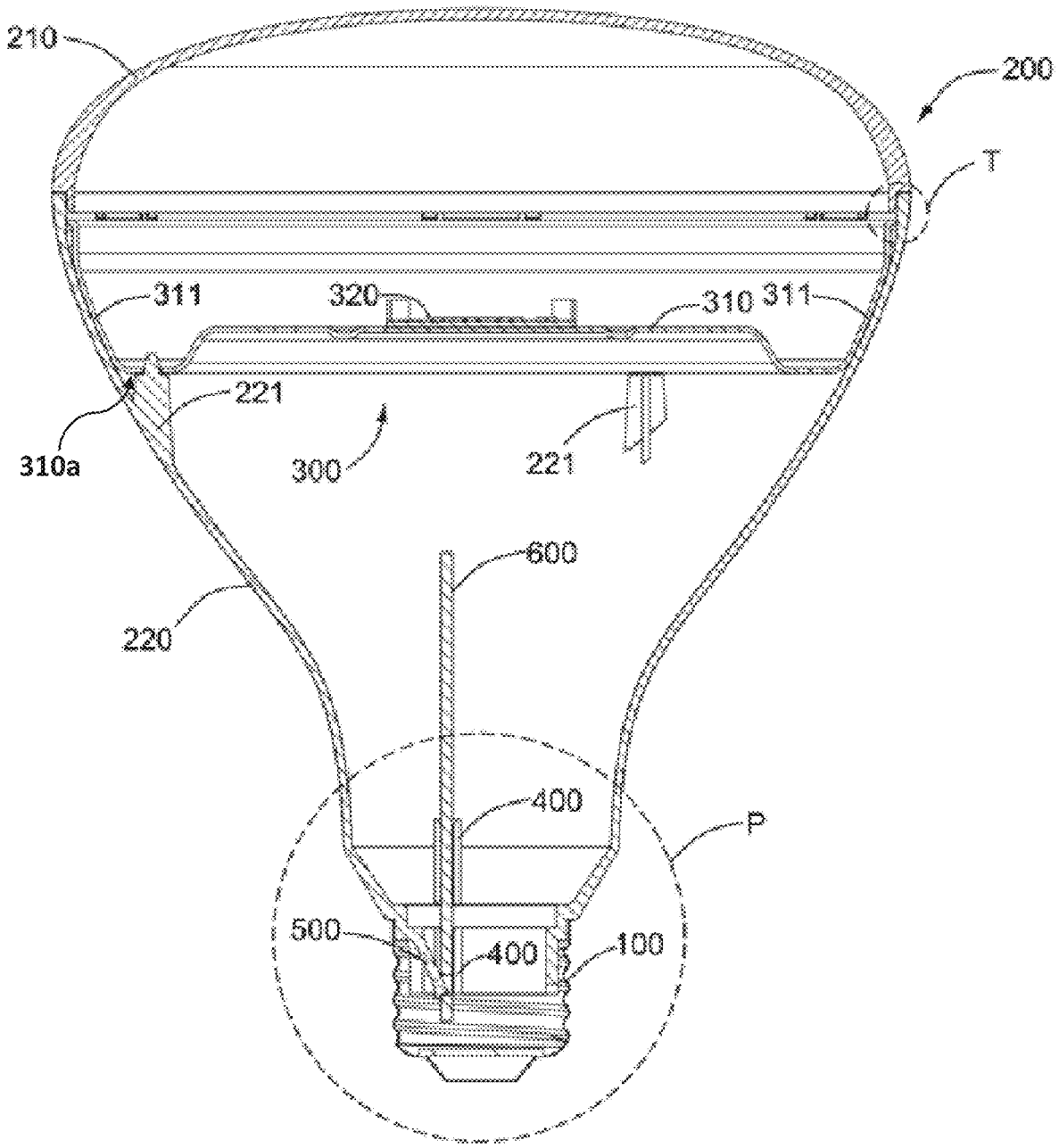
FIG. 5 is a schematic diagram of the cross section structure along the B-B direction in FIG. 2.

Please refer to FIGS. 1-5. FIG. 1 is a front elevation view of an LED lamp according to an embodiment of the present invention. FIG. 2 is a top view of the LED lamp as shown in FIG. 1. FIG. 3 is a schematic diagram of the cross section structure along the A-A direction in FIG. 2. FIG. 4 is a schematic diagram of another perspective of the LED lamp as shown in FIG. 3. FIG. 5 is a schematic diagram of the cross section structure along the B-B direction in FIG. 2.

According to an example embodiment of the present invention, LED lamp 90 comprises a base 100, a lamp body 200 coupled to the base 100, a light emitting assembly 300 arranged inside the lamp body 200, and a positioning component 400, a flexible component 500, and a driver board 600 fixed inside the lamp body 200.

The base 100 can be an Edison base. In some embodiments, the base 100 may also be a base with a different structure.

The lamp body 200, specifically the bottom of the lamp body 200, is coupled with the base 100. The light emitting assembly 300, the positioning component 400, the flexible component 500, and the driver board 600 are all arranged inside the lamp body 200. In some embodiments, part of the positioning component 400, the flexible component 500, and the driver board 600 may extend to the outside of the lamp body 200.

In some embodiments, the lamp body 200 comprises a cover 210 as well as a housing 220 coupled to the cover 210 and the base 100. The top of the housing 220 is coupled to the cover 210, and the bottom of the housing 220 is coupled to the base 100. In some embodiments, the cover 210 is transparent or semitransparent, and the housing 220 is opaque. The cover 210 may also be fastened to the housing 220.

The above lamp body 200 provides an example only and is not intended to limit the invention. The lamp body 200 of the present invention may take a variety of forms, all of which should be included within the scope of the present invention. For example, the cover 210 may be coupled to the housing 220 with an adhesive, etc.

The light emitting assembly 300 comprises an LED chip 320 used to emit light. In some embodiments, the light emitting assembly 300 also comprises a platform 310 arranged inside the lamp body 200 and an LED chip 320 arranged on the platform 310. The platform 310 may comprise a heat sink to dissipate heat from the LED chip 320, with this heat sink in contact with the LED chip 320. The platform 310 as a whole may act as a heat sink for the LED chip 320, and this heat sink may be made of material that dissipates heat easily, such as metal.

In the embodiment where the lamp body 200 comprises a cover 210 and a housing 220, the light emitting assembly 300 (more specifically, the platform 310) is coupled to the housing 220. The light emitting assembly 300 (the platform 310) may be fixed to the housing 220 using an adhesive.

Figure 6:
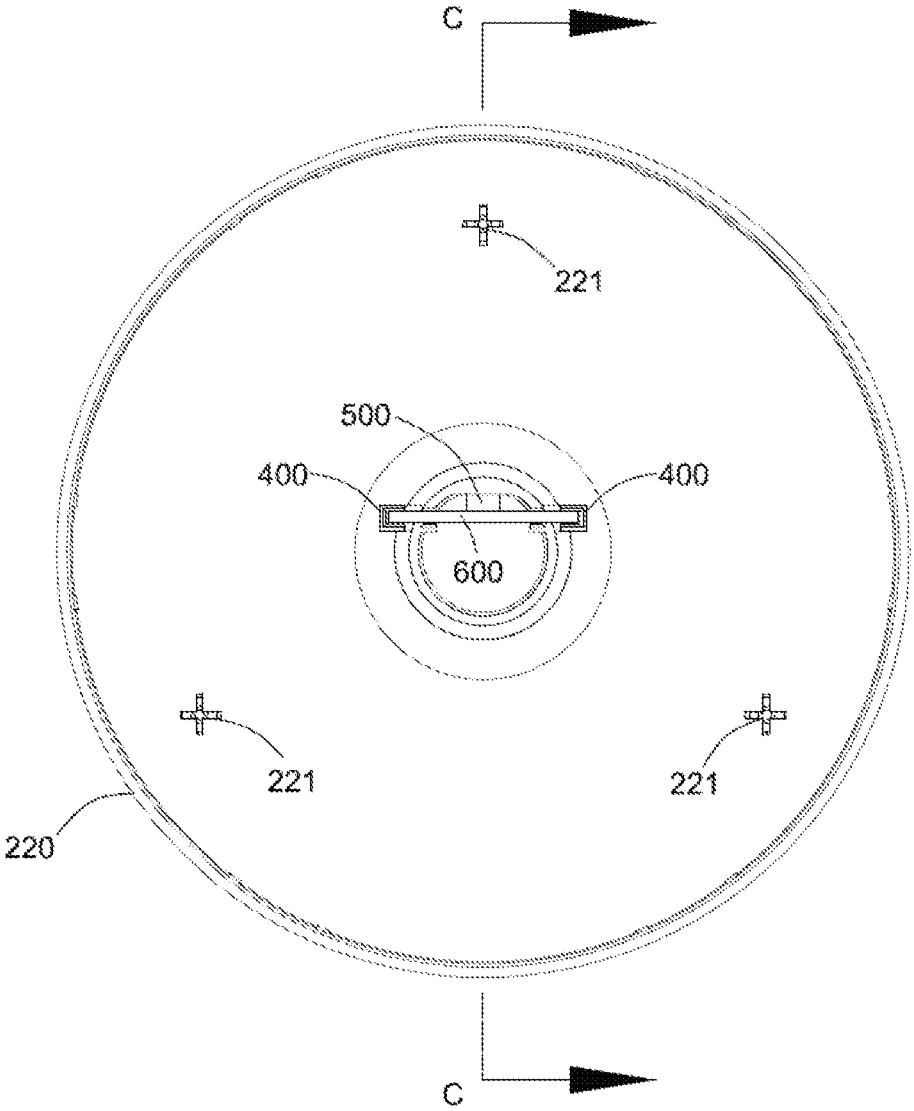
FIG. 6 is a top view of an LED lamp according to an embodiment of the present invention after the cover and light emitting assembly are removed.
Figure 7:
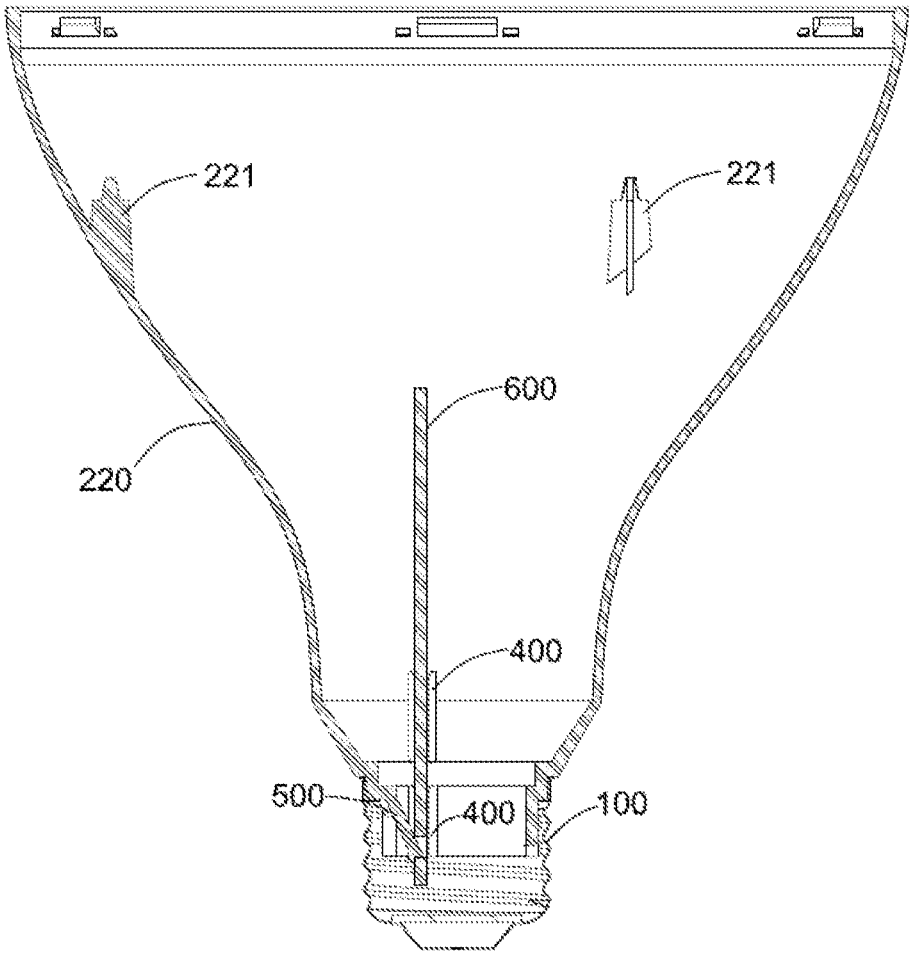
FIG. 7 is a schematic diagram of the cross section structure along the C-C direction in FIG. 6.

Please refer to FIGS. 3-7. FIG. 6 shows a top view of an LED lamp 90 according to an example embodiment of the present invention after the cover 210 and light emitting assembly 300 arc removed. FIG. 7 is a schematic diagram of the cross section structure along the C-C direction in FIG. 6. In some embodiments, the housing 220 comprises at least one bulge 221 and the platform 310 defines at least one hole 310*a*, whereby the at least one bulge 221 passes through the at least one hole to position the platform 310.

Figure 8:
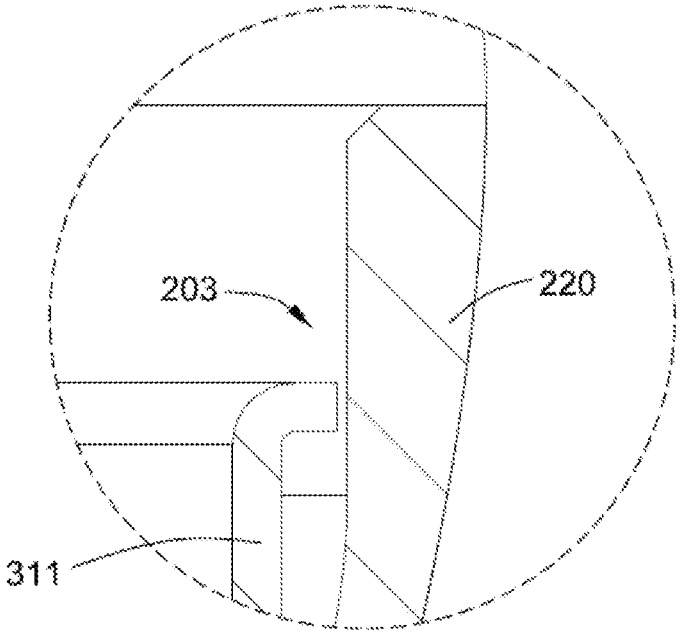
FIG. 8 is an enlarged schematic diagram of the T section in FIG. 5 after the cover is removed.

Please refer to FIGS. 3-5 and FIG. 8. FIG. 8 is an enlarged schematic diagram of the T section in FIG. 5 after the cover 210 is removed. In some embodiments, the platform 310 comprises a curved surface 311, whereby the shape of the curved surface 311 matches the shape of the corresponding part of the housing 220 so that the platform 310 can be coupled more easily to the housing 220 during assembly. In some embodiments, the outermost part of the curved surface 311 and the housing 220 forms a step 203, whereby the step 203 can reduce the possibility of the adhesive added between the platform 310 and the housing 220 from flowing down the curved surface 311.

The aforementioned light emitting assembly 300 provides an example only and is not intended to limit the invention. The light emitting assembly 300 of the present invention may take a variety of forms, all of which should be included within the scope of the present invention. For example, in some variations, the platform 310 of the light emitting assembly 300 may be coupled to the cover 210, or the platform 310 does not define a hole for the bulge 221 to pass through, but the platform 310 is positioned by resting on the bulge 221.

Figure 9:
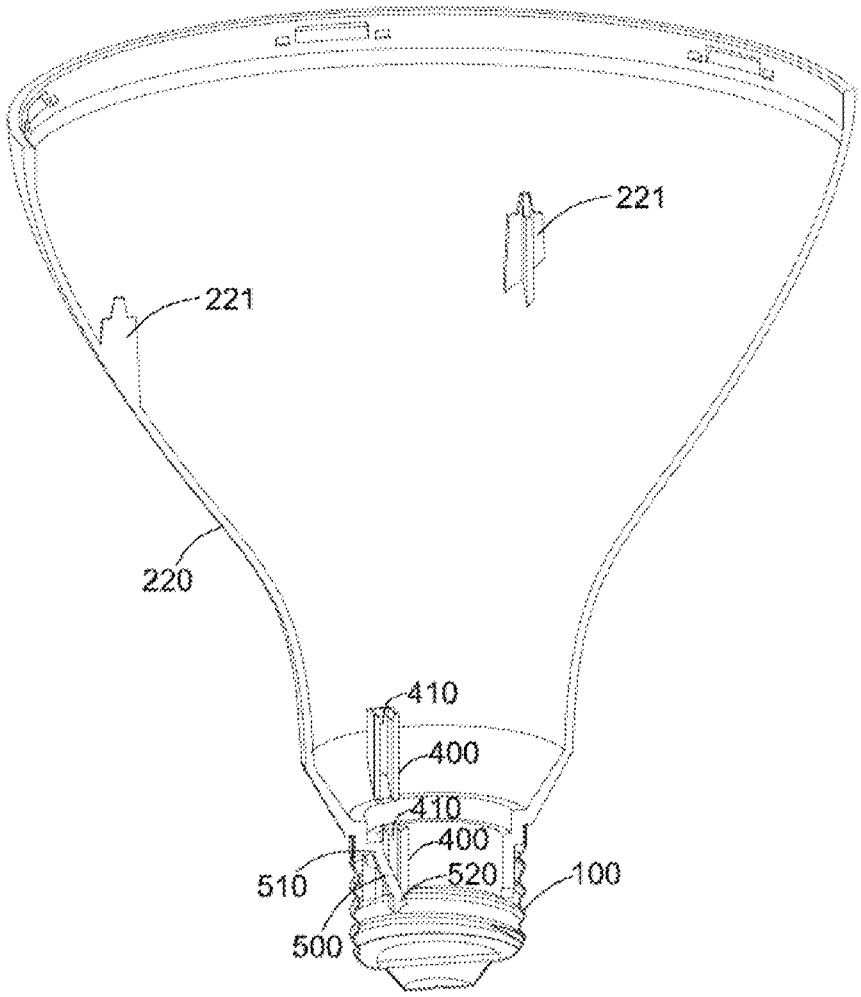
FIG. 9 is a schematic diagram of a positioning component and a flexible component fixed on the housing that is coupled to the base.
Figure 10:
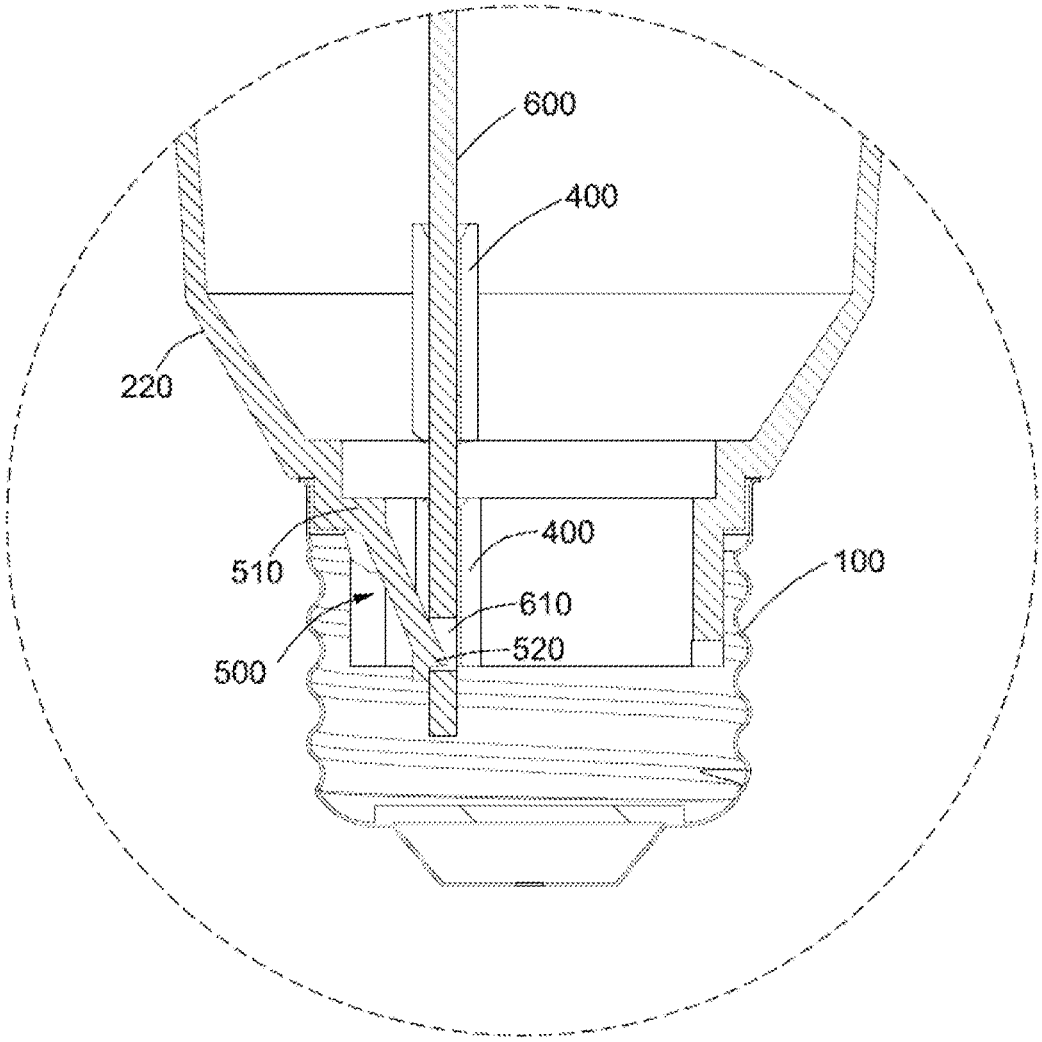
FIG. 10 is an enlarged schematic diagram of the P section in FIG. 5.
Figure 11:
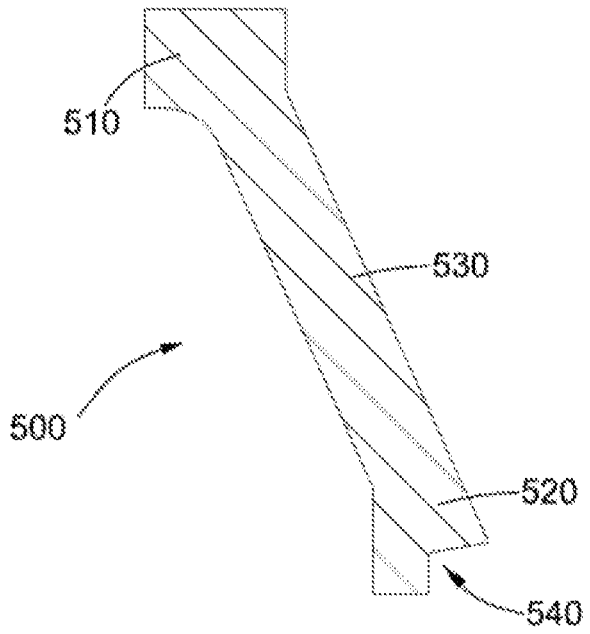
FIG. 11 is a schematic diagram of a flexible component according to an example embodiment of the present invention.

Please refer to FIGS. 3-5 and FIGS. 9-11. FIG. 9 is a schematic diagram of a positioning component 400 and a flexible component 500 fixed on the housing 220 that is coupled to the base 100. FIG. 10 is an enlarged schematic diagram of the P section in FIG. 5. FIG. 11 shows a schematic diagram of a flexible component 500 according to an embodiment of the present invention.

The positioning component 400 is fixed inside the lamp body 200, that is it is fixed to the inside of the housing 220 and defines a groove 410. In some embodiments, the positioning component 400 comprises multiple parts distributed within the housing 220 whereby each part defines a groove 410. The positioning component 400 may also be integrated with the housing 220.

The aforementioned positioning component 400 provides an example only and is not intended to limit the invention. The positioning component 400 of the present invention may take a variety of forms, all of which should be included within the scope of the present invention.

The flexible component 500 comprises a fixed end 510 and a free end 520, whereby the fixed end 510 is fixed to the lamp body 200 (more specifically, the housing 220), and the free end 520 is locked into the driver board 600. In some embodiments, when the driver board 600 is not yet assembled, the free end 520 may be oblique to the fixed end 510. The free end 520 may also have a locking portion 540.

In some embodiments, the flexible component 500 comprises a flexible arm 530, whereby one end of the flexible arm 530 is a fixed end 510 fixed to the lamp body 220 and the other end is a free end 520. When the free end 520 of the flexible arm 530 is subject to force in a direction different from the axial direction of the flexible arm 530, elastic deformation of the flexible arm 530 occurs and the free end 520 is oblique to the fixed end 510.

The aforementioned flexible component 500 provides an example only and is not intended to limit the invention. The flexible component 500 of the present invention may take a variety of forms, all of which should be included within the scope of the present invention. For example, the flexible component 500 may adopt a flexible structure other than a flexible arm 530.

The driver board 600 is electrically connected with the light emitting assembly 300 (more specifically, the LED chip 320) to drive the light emitting assembly 300 to emit light. In some embodiments, the driver board 600 comprises a drive circuit or a PCB (Printed Circuit Board).

The driver board 600 defines a slot 610. In some embodiments, the slot 610 is a depression or a through-hole on the driver board 600.

The driver board 600 is disposed in the groove 410 of the positioning component 400, and the free end 520 of the flexible component 500 is locked (wedged) into the slot 610 of the driver board 600. The groove 410 prevents the displacement of the driver board 600 in a direction perpendicular to the driver board 600, and the free end 520 locks into the slot 610 to prevent vertical displacement of the driver board 600. Therefore, the driver board 600 is fixed into position by the positioning component 400 and the flexible component 500.

In some embodiments, the flexible component 500 is oblique to the driver board 600, that is the flexible arm 530 of the flexible component 500 is oblique to the driver board 600. Therefore, when the driver board 600 is slid along the groove 410 to the bottom of the lamp body 200, the flexible component 500 can lock more easily into the slot 610. In some embodiments, the free end 520 has a locking portion 540 to match the slot 610, thereby allowing the free end 520 to lock into the slot 610 more easily.

In the embodiment where the positioning component 400 comprises multiple parts all defining a groove 410, both sides of the driver board 600 can be arranged in the groove 410.

The aforementioned driver board 600 provides an example only and is not intended to limit the invention. The driver board 600 of the present invention may take a variety of forms, all of which should be included within the scope of the present invention.

Figure 12:
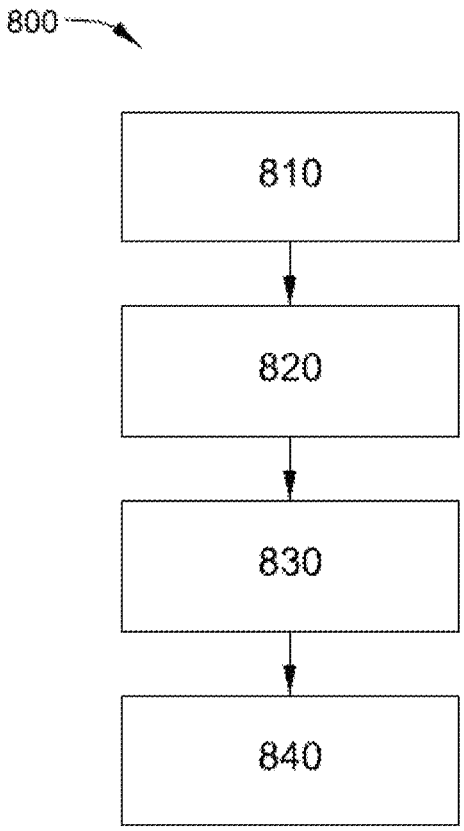
FIG. 12 is a flow diagram of the method for assembling an LED lamp according to an example embodiment of the present invention.
Figure 13:
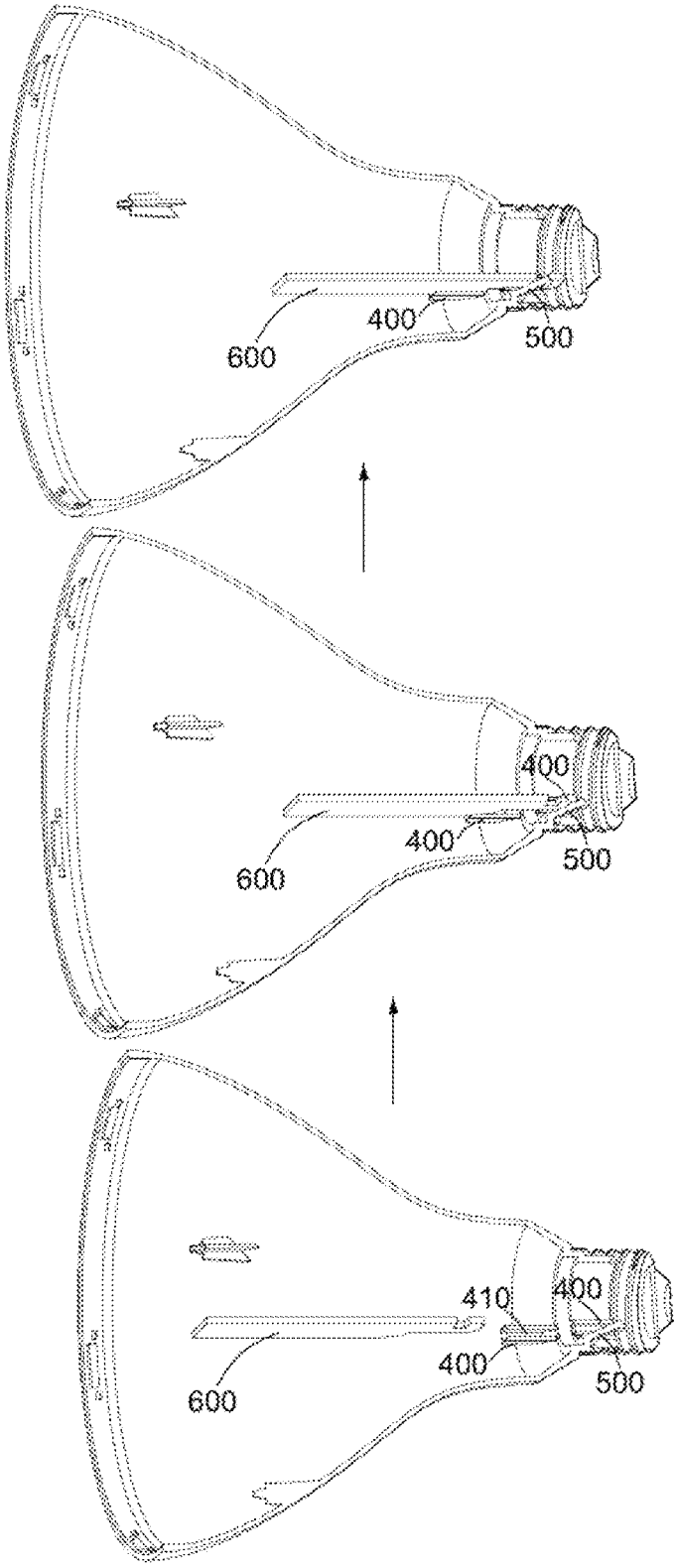
FIG. 13 is a schematic diagram of the assembly process of a driver board according to an example embodiment of the present invention.

Please refer to FIGS. 3-13. FIG. 12 is a flow diagram of the method 800 for assembling an LED lamp according to an example embodiment of the present invention. FIG. 13 is a schematic diagram of the assembly process of a driver board 600.

The method 800 comprises the following steps: 810, 820, 830, and 840.

As shown in FIG. 13, step 810 involves sliding a driver board 600 along a groove 410 of a positioning component 400 fixed on a housing 220 until a free end 520 of a flexible component 500 fixed onto the housing 220 is locked into a slot 610 of the driver board 600 so that the driver board 600 is assembled to the housing 220.

While sliding the driver board 600 along the groove 410 to the bottom of the housing 220, when the driver board 600 touches the flexible component 500, the flexible component 500 will start to elastically deform. As the driver board 600 continues to be slid along the groove 410, elastic deformation of the flexible component 500 becomes greater. When the driver board 600 is in a position where the free end 520 of the flexible component 500 is in contact with the slot 610, the force exerted on the flexible component 500 disappears. The flexible component 500 rebounds and its original shape is fully or essentially restored, thereby the free end 520 is locked into the slot 610 of the driver board 600. Thus, the driver board 600 is fixed by the positioning component 400 and the flexible component 500.

In step 820, the light emitting assembly 300 is electrically connected with the driver board 600, and the light emitting assembly 300 is coupled to the housing 220.

In some embodiments, the step of electrically connecting the light emitting assembly 300 with the driver board 600 further comprises electrically connecting the LED chip 320 within the light emitting assembly 300 with the driver board 600. The light emitting assembly 300 may be electrically connected with the driver board 600 via a lead (not shown). This lead may extend out from the LED chip 320 and pass through a specially designated hole on the platform 310 to connect with the driver board 600.

In some embodiments, mounting the light emitting assembly 300 onto the housing 220 comprises placing the light emitting assembly 300 inside the housing 220 and enabling the bulge 221 on the housing 220 to pass through the hole in the platform 310 of the light emitting assembly 300. Adhesive is then added between the platform 310 and the housing 220 to fix the two together. In the embodiment where a step 203 is formed between the platform 310 and the housing 220, adhesive is added to the step 203.

The aforementioned step 820 provides an example only and should not be understood as a limitation of the invention. The step 820 according to the present invention may take a variety of forms, all of which should be included within the scope of the present invention. For example, the light emitting assembly 300 can employ a method other than a lead to electrically connect with the driver board 600. In addition, when mounting the light emitting assembly 300 onto the housing 220, if the platform 310 does not define any holes for the bulge 221 to pass through, the light emitting assembly 300 may be positioned by resting the platform 310 on the bulge 221. Adhesive may then be added between the platform 310 and the housing 220 to fix the two together.

In step 830, a cover 210 is coupled to the housing 220.

In some embodiments, step 830 comprises fastening a cover 210 to the housing 220. The cover 210 coupled to the housing 220 may also touch or draw near to the platform 310.

In step 840, a base 100 is coupled to the housing 220. In some embodiments, step 840 comprises fixing a base 100 to the bottom of the housing 220.

It is important to note that the sequence of steps 810, 820, 830, and 840 as shown in FIG. 12 provides an example only and should not be understood as a limitation of the invention. The possible sequence of these steps is not limited to the sequence as shown in FIG. 12. For example, step 840 may be performed prior to any one of step 810, 820, or 830.

In some embodiments, the method 800 further comprises the following step of arranging an LED chip 320 onto a platform 310 arranged inside the housing 220 to obtain the light emitting assembly 300. This step may be performed prior to step 820.

An embodiment of the present invention uses a positioning component 400 and a flexible component 500 to fix the driver board 600. Moreover, when assembling the driver board 600, provided that the driver board 600 is slid along the groove 410 of the positioning component 400, elastic deformation of the flexible component 500 can be used to easily lock the free end 520 of the flexible component 500 into the slot 610 of the driver board 600 so as to fix the driver board 600 in place. Compared with the existing method of securing a driver board 600 with solid protrusions, this method for assembling a driver board 600 is extremely simple. It does not easily damage components, and assembly has a high success rate and is low cost.

While the present invention has been described in detail with reference to specific embodiments thereof, it will be understood by those skilled in the art that many modifications and variations can be made in the present invention. It is, therefore, to be understood that the appended claims are intended to cover all such modifications and variations insofar as they are within the true spirit and scope of the invention.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An LED lamp, comprising:

a base;

a lamp body coupled to the base and comprising at least one bulge integrally formed therein;

a light emitting assembly arranged inside the lamp body and comprising a platform arranged inside the lamp body and an LED chip arranged on the platform wherein the platform rests on the at least one bulge;

a positioning component fixed on the lamp body and defining a groove;

a flexible component having a fixed end fixed to the lamp body and a free end; and a driver board defining a slot and electrically connected with the light emitting assembly, wherein the driver board is disposed in the groove and the free end of the flexible component is locked into the slot.

2. An LED lamp, comprising:

a base;

a lamp body comprising a housing coupled to the base and comprising at least one bulge integrally formed therein; and a light emitting assembly arranged inside the lamp body and comprising:

a platform arranged inside the lamp body and an LED chip arranged on the platform wherein the platform rests on the at least one bulge.

3. The LED lamp of claim 2, wherein the platform defines a hole, and the at least one bulge passes through the hole.

4. The LED lamp of claim 2, wherein the platform comprises a heat sink to dissipate heat from the LED chip.

5. The LED lamp of claim 2, wherein the platform is a heat sink to dissipate heat from the LED chip.

6. The LED lamp of claim 2, wherein the platform is fixed to the housing by adding an adhesive between the platform and the housing.

7. The LED lamp of claim 3, wherein the platform is fixed to the housing by adding an adhesive between the platform and the housing.

8. The LED lamp of claim 6, wherein the platform comprises a curved surface wherein a shape of the curved surface matches a shape of a corresponding part of the housing wherein the platform is coupled to the housing.

9. The LED lamp of claim 8, wherein an outermost part of the curved surface and the housing form a step between the platform and the housing, wherein the adhesive added to the step.

10. The LED lamp of claim 8, wherein the at least one bulge comprises a plurality of bulges.

* * * * *